US008565629B2

(12) United States Patent
Kawakami

(10) Patent No.: US 8,565,629 B2
(45) Date of Patent: Oct. 22, 2013

(54) IMAGE FORMING APPARATUS

(75) Inventor: Rikuo Kawakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 368 days.

(21) Appl. No.: 12/970,059

(22) Filed: Dec. 16, 2010

(65) Prior Publication Data

US 2011/0150515 A1 Jun. 23, 2011

(30) Foreign Application Priority Data

Dec. 18, 2009 (JP) ..... 2009-288516

(51) Int. Cl.
*G03G 15/16* (2006.01)

(52) U.S. Cl.
USPC ..... 399/66

(58) Field of Classification Search
USPC ..... 399/66, 310, 313, 314
See application file for complete search history.

(56) References Cited

U.S. PATENT DOCUMENTS

| | | | | |
|---|---|---|---|---|
| 2006/0029410 | A1* | 2/2006 | Deguchi | 399/66 |
| 2009/0196638 | A1* | 8/2009 | Sukesako et al. | 399/45 |

FOREIGN PATENT DOCUMENTS

| | | | |
|---|---|---|---|
| JP | 6-95519 | A | 4/1994 |
| JP | 6-242692 | A | 9/1994 |
| JP | 2004-4283 | A | 1/2004 |
| JP | 2001-255785 | A | 9/2010 |

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image forming apparatus includes an image bearing member, a charger for electrically charging the member, an electrostatic latent image forming device for forming an electrostatic latent image on the member, a developer for developing the electrostatic latent image into a toner image, a transferer for transferring the toner image from the member onto a recording material and including a transfer member to which a transfer voltage is to be applied, a transfer-voltage source variably setting the transfer voltage, and a circuit for detecting a current passing between the image bearing and the transfer members by the transfer voltage applied from the voltage source, and a controller for controlling the voltage source. The controller sets the transfer-voltage value, applied from the voltage source during a non-passing period of the recording material, so that a predetermined current is detected by the circuit.

2 Claims, 9 Drawing Sheets

IMAGE FORMING APPARATUS

FIELD OF THE INVENTION AND RELATED ART

The present invention relates to an image forming apparatus using an electrophotographic process, such as a copying machine or a printer.

In a conventional image forming apparatus using the electrophotographic process, a toner image formed on a photosensitive drum is transferred onto a recording material (sheet) P by a transfer member to which a transfer voltage has been applied. Thereafter, the recording material P on which the toner image is transferred is conveyed to a fixing device including heating/pressing means, in which the toner image is fixed on the recording material P and then the recording material P is discharged to the outside of the image forming apparatus.

In a series of steps of the electrophotographic process, there is a variation in the amount of negative electric charge assumed by the toner. The toner having a small electric charge amount has a small electrostatic attraction force to the photosensitive-drum surface, so that a part of the toner can be separated from the photosensitive-drum surface during a transition process from a developing process to a transfer process. The toner separated from the photosensitive-drum surface has a negative electric charge in many cases, so that the toner is attracted to a transfer roller to which a voltage of the photosensitive drum is applied, and is accumulated.

By continuously using the image forming apparatus for a long term, a large amount of the toner is accumulated on the transfer roller and then the toner is deposited on a back surface of the sheet in the transfer process (hereinafter referred to as backside contamination).

Japanese Laid-Open Patent Application (JP-A) Hei 6-95519 has proposed the following method as a method for preventing the phenomenon of the backside contamination.

A certain value of a voltage of the negative polarity opposite to a polarity of a voltage applied during printing is applied to the transfer roller, so that the toner on the transfer roller is moved to the photosensitive drum by repulsion with respect to the negative electric charge assumed by the toner. Then, the toner moved on the photosensitive-drum surface is collected and accommodated in a residual-toner container provided in a process cartridge.

However, according to the above method, the negative voltage of a certain value is applied to the transfer roller, so that a potential difference between a surface potential of the photosensitive drum and the applied voltage value varies depending on the state of the image forming apparatus. In the case where the potential difference is large, the toner is electrically charged by the transfer voltage during the movement to the photosensitive drum, so that the potential difference between the electric charge amount of the toner and the surface potential of the photosensitive drum is also large. Therefore, the repulsive force of the toner having the electric charge amount from the photosensitive drum having the surface potential is increased, and thus the electrostatic attraction force of the toner onto the photosensitive drum is weakened, so that the toner is separated from the photosensitive-drum surface before the toner is collected by the residual-toner container. Such toner remains in the image forming apparatus, thus causing contamination of the inside of the image forming apparatus.

On the other hand, in the case of a small potential difference, the movement of the toner from the transfer roller onto the photosensitive drum is not sufficiently effected, so that a sufficient backside-contamination-preventing effect cannot be obtained.

SUMMARY OF THE INVENTION

A principal object of the present invention is to provide an image forming apparatus capable of suppressing the backside contamination phenomenon of a recording material and capable of suppressing a toner-scattering phenomenon by effecting toner control during cleaning on the basis of a current value of a transfer voltage.

According to an aspect of the present invention, there is provided an image forming apparatus comprising:

an image bearing member;

a charging device for electrically charging the image bearing member;

an electrostatic latent image forming device for forming an electrostatic latent image on the image bearing member;

a developing device for developing the electrostatic latent image into a toner image;

a transfer device for transferring the toner image from the image bearing member onto a recording material, the transfer device including a transfer member to which a transfer voltage is to be applied, a transfer-voltage source capable of variably setting the transfer voltage, and a current-detecting circuit for detecting a current passing between the image bearing member and the transfer member by the transfer voltage applied from the transfer-voltage source; and a controller for controlling the transfer-voltage source. The controller sets a value of the transfer voltage, to be applied from the transfer-voltage source during a non-passing period of the recording material, so that a predetermined current is detected by the current-detecting circuit. The predetermined current is preset as a current not causing electric discharge between the image bearing member and the transfer member but causing the toner image to move from the transfer member to the image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, preferred embodiments of the present invention will be described specifically in an exemplary manner with reference to the drawings. However, dimensions, materials, shapes, relative positions of constituent elements described in the following embodiments may be appropriately changed depending on constitutions and various conditions of image forming apparatuses to which the present invention is applied.

Embodiment 1

Figure 1:
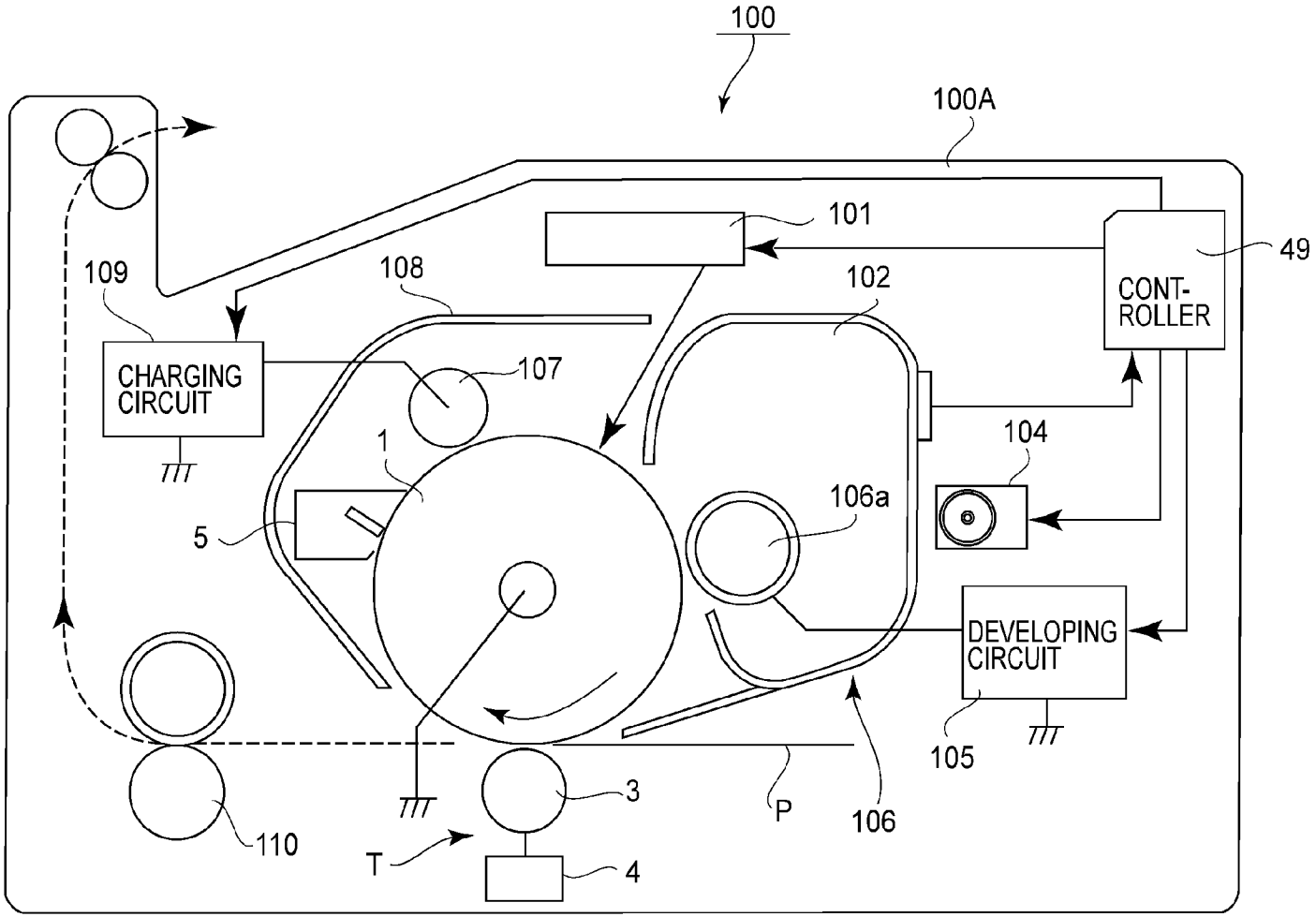
FIG. 1 is a schematic structural view of an embodiment of the image forming apparatus according to the present invention.

FIG. 1 is a schematic sectional view of an embodiment of an image forming apparatus using an electrophotographic process according to the present invention. In this embodiment, an image forming apparatus 100 is a laser beam printer of an electrophotographic type.

In the image forming apparatus 100, at a periphery of a photosensitive drum 1 as an image bearing member, a charging roller 107, which is a charging device for electrically charging the surface of the photosensitive drum 1, a laser emitting device 101, which is an electrostatic latent image forming device, and a developing device 106, are disposed. To the charging roller 107, a high voltage is applied from a charging circuit 109. The developing device 106 includes a developing sleeve 106*a* which is disposed adjacent to the photosensitive drum 1 and is configured to visualize the electrostatic latent image with the toner, and includes a toner container 102, which holds the toner as a developer. The photosensitive drum 1 is electrically grounded.

In this embodiment, the photosensitive drum 1, the charging roller 107 and the developing device 106 are integrally assembled into a process cartridge 108, which is detachably mountable to a main assembly 100A of the image forming apparatus 100. The process cartridge 108 is driven by a cartridge monitor 104, so that the photosensitive drum 1, the charging roller 107, the developing sleeve 106*a*, and the like are driven.

In this embodiment, the surface of the photosensitive drum 1 is negatively charged uniformly by a voltage applied to the charging roller 107. The photosensitive-drum surface is exposed, depending on image data, to laser light emitted from the laser emitting device (laser scanner) 101 and thus an exposed portion is discharged, so that the electrostatic latent image is formed. The electrostatic latent image on the photosensitive-drum surface is developed with the toner by a voltage applied to the developing sleeve 106*a*, so that a toner image (visible image) is formed. The toner image on the photosensitive-drum surface is transferred onto a recording material such as a transfer sheet P by a transfer device T. That is, the toner image is transferred onto the sheet P by a transfer voltage of the photosensitive drum applied from a transfer-voltage source 4 constituting the transfer device T to a transfer member 3, such as a transfer roller. As the transfer member 3, it is also possible to utilize a transfer blade, a transfer brush, and the like.

The sheet P on which the toner image is transferred is conveyed to a fixing device 110, in which the toner image is fixed on the sheet P by heat and pressure. Then, the sheet P is discharged to the outside of the image forming apparatus 100.

Figure 3:
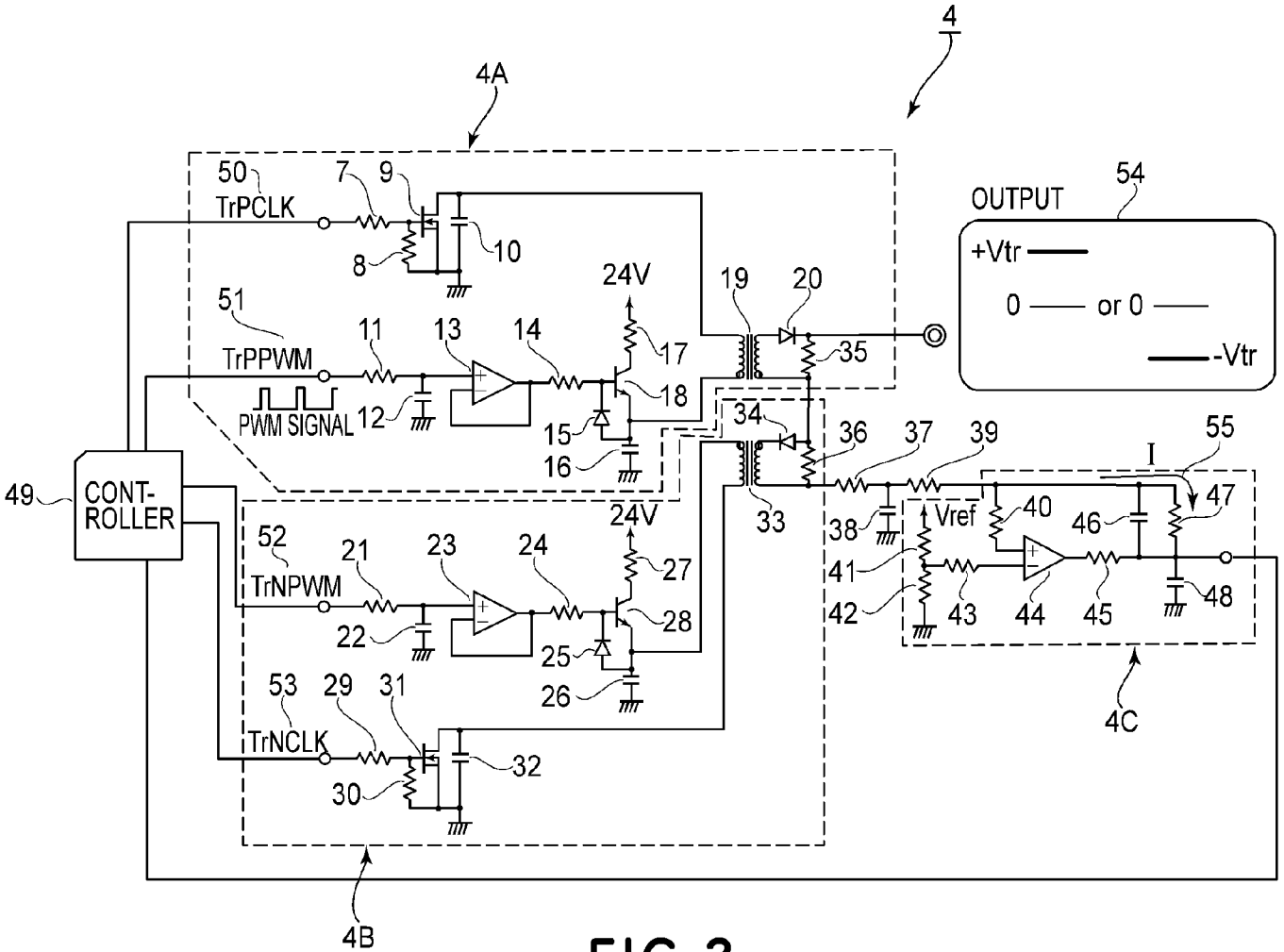
FIG. 3 is a circuit diagram for generating high-voltage output for transfer in Embodiment 1 and Embodiment 2 of the present invention.

A constitution of the transfer-voltage source (transfer voltage generating means) 4 in this embodiment is shown in FIG. 3. In this embodiment, the transfer-voltage source 4 is constituted by a positive voltage circuit 4A, a negative voltage circuit 4B and a current-detecting circuit 4C.

Referring to FIG. 3, the transfer-voltage source 4 includes, as electric circuit constituent elements, high-voltage transformers 19 and 33; transistors 18 and 28; FETs 9 and 31; high voltage diodes 20 and 34; diodes 15 and 25; operational amplifiers 13, 23 and 44; capacitors 10, 12, 16, 22, 26, 32, 38, 46 and 48; a controller (CPU) 49, and resistors 7, 8, 11, 14, 17, 21, 24, 27, 29, 30, 35, 36, 37, 39, 40, 41, 42, 43, 45 and 47.

A high-voltage output for transfer from the transfer-voltage source 4 is a voltage 54, which includes DC components of the positive polarity and the negative polarity. The level of the DC voltage of each of the positive polarity and the negative polarity can be changed variably.

With reference to FIG. 3, an operation of the positive voltage circuit 4A will be described.

A signal for variably changing the voltage of the positive polarity is TrPPWM 51, which is a PWM signal. The PWM signal is smoothed by the resistor 11 and the capacitor 12 to provide a PC voltage corresponding to the duty ratio of the PWM signal. By the DC voltage, the base voltage of the transistor 18 is controlled and the primary voltage of a high-voltage transformer 19 is determined.

Further, a signal for performing the drive of the high-voltage transformer 19 is TrPCLK 50, which is a clock signal. Switching the driving of the high-voltage transformer 19 is performed by the clock signal TrPCLK 50 from the CPU 49, so that the primary voltage is amplified by the high-voltage transformer 19 and then is outputted. Here, a high-voltage output outputted to the secondary side of the transformer is an output of the positive polarity depending on the winding direction and the turn ratio of coils of the high-voltage transformer 19.

Next, with reference to FIG. 3, an operation of the negative voltage circuit 4B will be described.

The operation of the PWM signal circuit of TrNPWM 52 for variably changing the voltage of the negative polarity and the operation of the clock signal circuit of TrNCLK 53 for performing the driving of the high-voltage transformer 33 are the same as those in the positive voltage circuit 4A. Here, the high-voltage output outputted to the secondary side is an output of the negative polarity, depending on the winding direction and the turn ratio of coils of the high-voltage transformer 33.

Then, with reference to FIG. 3, an operation of the current-detecting circuit 4C for detecting the current passing through a transfer-voltage circuit will be described.

As shown in FIG. 3, the current-detecting circuit 4C is constituted by the operational amplifier 44 and a reference voltage Vref. The current passing through the transfer-voltage circuit passes through the current-detecting circuit 4C along a path 55 indicated by an arrow in FIG. 3. At this time, the reference voltage (0.5 V) is inputted into a non-inverting input of the operational amplifier 44, so that the non-inverting input has the same voltage as the reference voltage by a virtual short. Further, to an output of the operational amplifier 44, the resistance 47 for current detection is connected. Therefore, by monitoring a potential difference from the reference voltage at a detection resistance portion, the current passing through the transfer-voltage circuit can be detected.

Next, a transfer-voltage-setting method during printing will be described.

In this embodiment, the voltage applied to the transfer roller 3 during printing is of the positive polarity. Further, the toner image formed on the photosensitive-drum surface after the developing process assumes the negative electric charge.

Therefore, the high voltage of the positive polarity is applied to the transfer roller 3 of the transfer means T, so that the toner image is transferred from the photosensitive-drum surface onto the sheet P. At this time, an output I of the current-detecting circuit 4C is monitored and adjustment of the duty of the PWM signal is performed so that a current of 8.5 μA flows. That is, a detected voltage value is obtained by adding a voltage drop, during passage of the current of 8.5 μA through the detection resistor 47, to the reference voltage of 0.5 V. In this embodiment, the resistance of the resistor 47 is 100 kΩ, so that the detected voltage value is 1.35 V. The PWM duty when the voltage of 1.35 V is detected by the CPU is taken as a set value for the transfer voltage to be applied.

Figure 2:
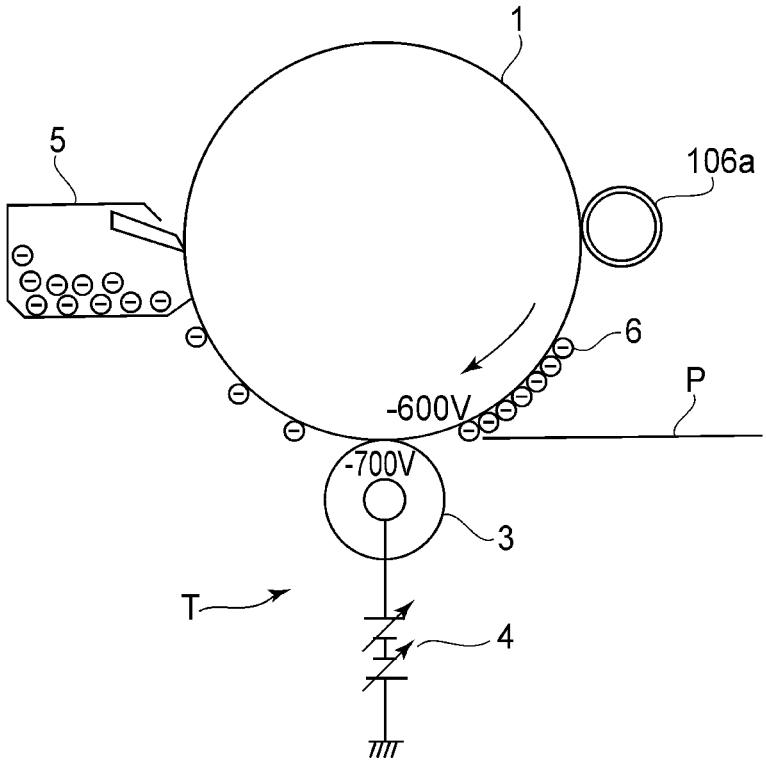
FIG. 2 is a schematic structural view for illustrating high-voltage control for transfer.

Next, with reference to FIG. 2, the transfer-voltage-setting method during cleaning of the transfer roller 3 will be described.

The cleaning of the transfer roller 3 is performed when the recording material, i.e., the sheet P does not pass through the position of the transfer device T (during a non-passing period). During the cleaning, the voltage applied to the transfer roller 3 is of the negative polarity, which is the same as the toner charge polarity. Here, toner 6 assumes a negative electric charge and therefore, the toner deposited on the transfer roller 3 can be moved to the photosensitive drum 1 by applying a voltage of the negative polarity to the transfer roller 3. The toner 6 moved on the photosensitive drum 1 is collected in the residual-toner container 5.

Figure 9:
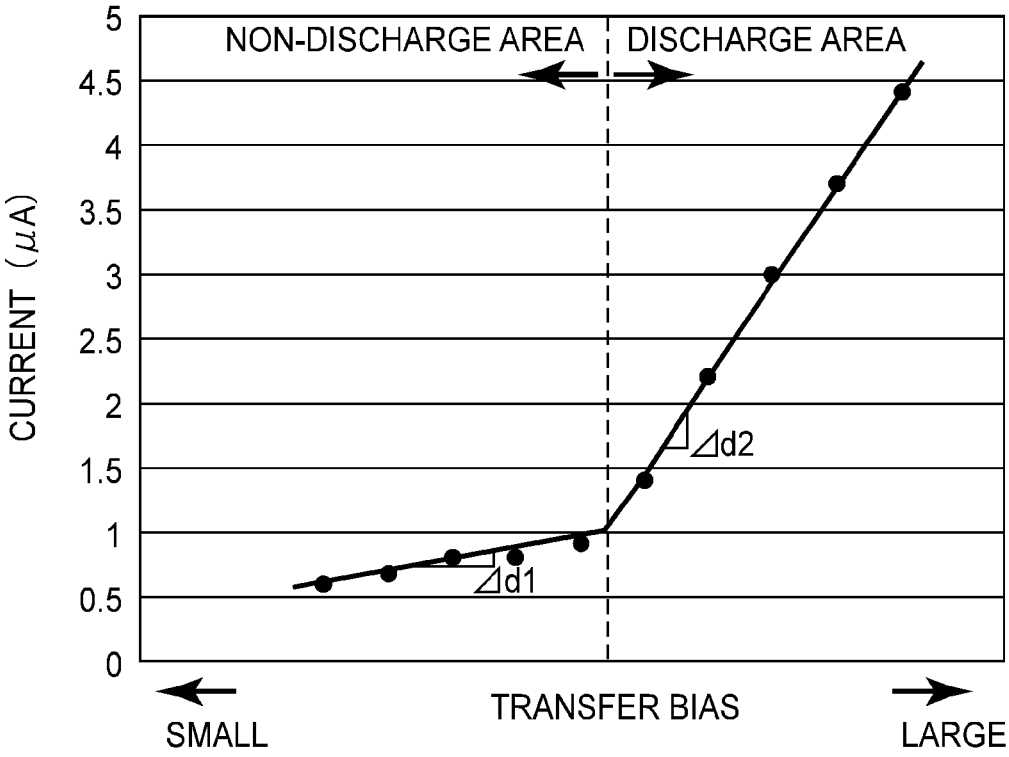
FIG. 9 is a graph showing a relationship between a transfer voltage and a current value in the present invention.

The value of the transfer voltage applied to the transfer roller 3 at that time is determined in the following manner. That is, the transfer-voltage value is determined by monitoring the output I of the current-detecting circuit 4C and then by performing adjustment of the duty of the PWM signal so as to detect the current value of 1 μA at which the electric discharge does not occur between the photosensitive drum 1 and the transfer roller 3, as shown in the graph of FIG. 9. The current value is determined so that the potential difference between the photosensitive drum 1 and the transfer roller 3 is not more than an electric-discharge threshold.

That is, the detected voltage is 0.4 V, which is obtained by subtracting the voltage drop, when the current of 1 μA passes through the detection resistor 47, from the reference voltage of 0.5 V. The PWM duty at the time of detecting the voltage of 0.4 V by the CPU (controller) 49 is taken as the set value for the transfer voltage. At this time, the surface potential of the photosensitive drum 1 is about −600 V, and the transfer voltage is set at a value larger than the photosensitive-drum surface potential by 100 V in absolute value, i.e., set at about −700 V.

Figure 4:
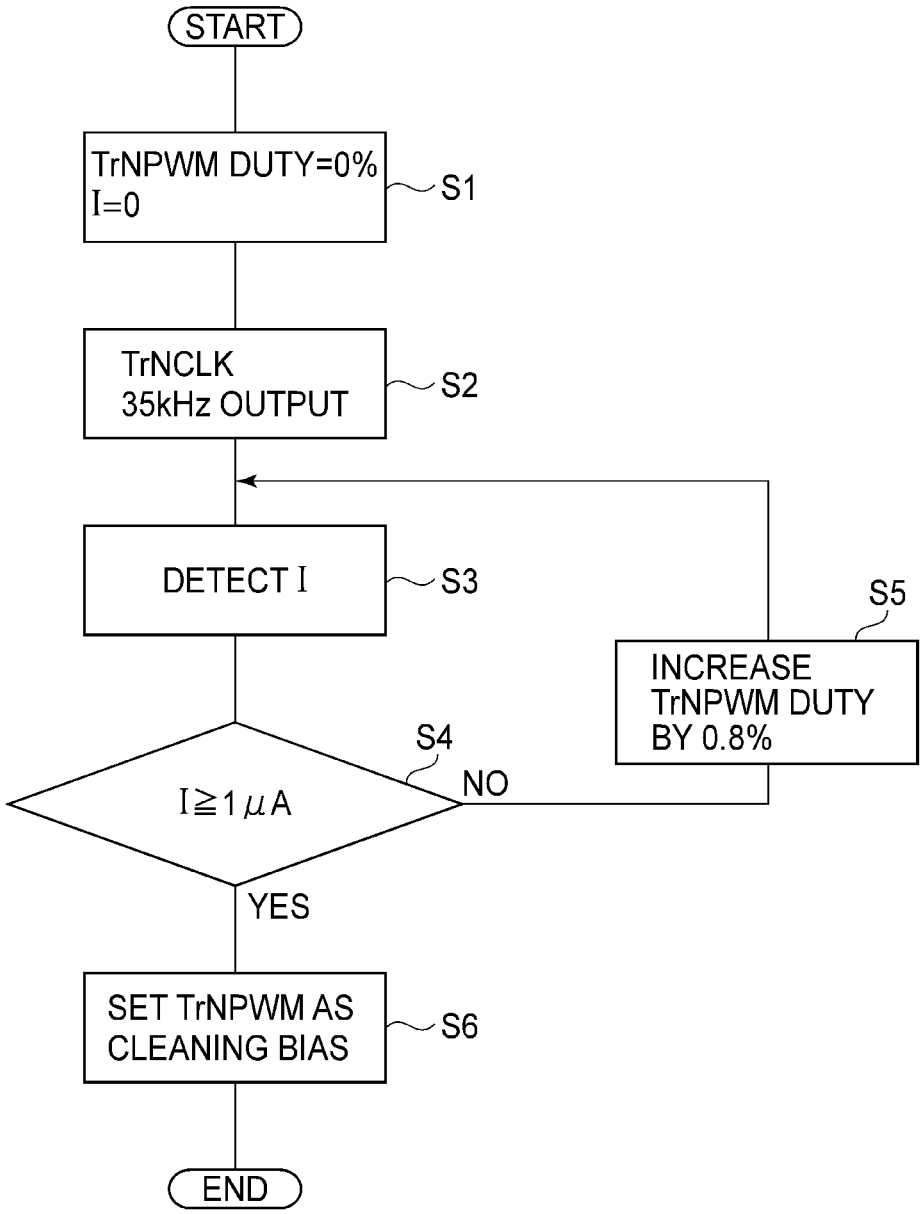
FIG. 4 is a flow chart showing high-voltage control for transfer in Embodiment 1 of the present invention.

FIG. 4 is a flow chart showing a setting procedure of the value of the transfer voltage to be applied to the transfer roller 3 during the transfer-roller cleaning.

First, the duty of the TrNPWM signal is set at 0%, and the value of a detection current I is set at an initial value (=0) (S1). As a result, the level of the transfer voltage is set at about zero.

Next, a clock signal of 35 kHz is inputted into the TrNCLK signal (S2). At this time, the duty of the TrNPWM signal is 0% and thus the transfer output is 0 V. Then, the current value I flowing at this time is monitored (S3). It is determined whether the monitored current value (absolute value) I is 1 μA or more (S4). When the monitored current value I is less than 1 μA, the duty of the TrNPWM signal is increased by 0.8% (2/255 (%)) (S5) and then the current I is monitored again (S4). This procedure is continued until the current value (absolute value) I is 1 μA or more. When the current value I is determined as being 1 μA or more, the duty of the TrNPWM signal is taken as the set value, further TrNPWM signal during the transfer-roller cleaning (S6).

As described above, in this embodiment, the transfer means T includes the negative transfer voltage circuit 4B capable of variably changing the output. The CPU 49 performs the setting of the voltage value during the transfer-roller cleaning by the transfer means T so that the TrNPWM signal is set so as to provide the current value of 1 μA, which is a non-electric discharge current value of the current passing through the transfer-voltage circuit.

As a result, the transfer-voltage value is set at a value that is lower than the surface potential of the photosensitive drum 1 by about −100 V, so that the toner can be moved from the transfer roller 3 onto the photosensitive drum 1 with reliability. Further, the transfer-voltage value is set at the value causing no electric discharge between the photosensitive drum 1 and the transfer roller 3, and therefore, the surface potential of the photosensitive drum 1 is not influenced by the transfer-voltage value.

Therefore, the toner moved to the photosensitive drum 1 is reliably carried to the residual-toner container 5 by the repulsive force with respect to the surface potential of the photosensitive drum 1 without being separated from the photosensitive-drum surface.

Thus, it is possible to suppress backside contamination of the sheet and toner scattering inside the image forming apparatus.

Embodiment 2

An image forming apparatus in this embodiment will be described.

Also in this embodiment, the image forming apparatus and a transfer-voltage source have the same constitutions as those of the image forming apparatus 100 and the transfer-voltage source 4 described in Embodiment 1 with reference to FIGS. 1 and 3, and thus the description thereof is omitted as being redundant.

Also in this embodiment, the operations of the positive transfer-voltage circuit 4A, the negative transfer-voltage circuit 4B and the current-detecting circuit 4C are the same as those in Embodiment 1, respectively.

Next, a transfer-voltage-setting method during printing will be described.

In this embodiment, the voltage applied to the transfer roller 3 during the printing is of the positive polarity. Further, the toner image formed on the photosensitive-drum surface after the developing process assumes the negative electric charge. Therefore, the high voltage of the positive polarity is applied to the transfer roller 3 of the transfer means T, so that the toner image is transferred from the photosensitive-drum surface onto the sheet P. At this time, an output I of the current-detecting circuit 4C is monitored and adjustment of the duty of the PWM signal is performed so that the current of 8.5 μA flows. That is, a detected voltage value is obtained by adding a voltage drop, during passage of the current of 8.5 μA through the detection resistor 47, to the reference voltage of 0.5 V. In this embodiment, the resistance of the resistor 47 is 100 kΩ, so that the detected voltage value is 1.35 V. The PWM duty when the voltage of 1.35 V is detected by the CPU is taken as a set value for the transfer voltage to be applied.

Next, the transfer-voltage-setting method during cleaning of the transfer roller 3 will be described.

During the cleaning, the voltage applied to the transfer roller 3 is of the negative polarity. Here, the toner 6 assumes a negative electric charge, and therefore, the toner deposited on the transfer roller 3 can be moved to the photosensitive drum 1 by applying the voltage of the negative polarity to the transfer roller 3. The toner 6 moved on the photosensitive drum 1 is collected in the residual-toner container 5.

The value of the transfer voltage applied to the transfer roller 3 at that time is determined by monitoring the output I of the current-detecting circuit 4C and then by performing adjustment of the duty of the PWM signal so as to detect a point at which a slope Δd of the current value with respect to the transfer voltage is changed from Δd1 in an area in which the electric discharge does not occur between the photosensitive drum 1 and the transfer roller 3 to Δd2 in an area in which the electric discharge occurs as shown in the graph of FIG. 9. That is, the transfer-voltage value is gradually increased and the electric discharge of the current is started, so that the point at which the slope of the current value with respect to the transfer voltage is changed from Δd1=0.06 to Δd2=0.6 is detected. Therefore, the PWM duty immediately before the detection by the CPU (controller) 49 that the slope reaches Δd2=0.6 is taken as the set value for the transfer voltage. At this time, the surface potential of the photosensitive drum 1 is about −600 V, and the transfer voltage is set at a value larger than the photosensitive-drum-surface potential by 100 V in absolute value, i.e., set at about −700 V.

Figure 5:
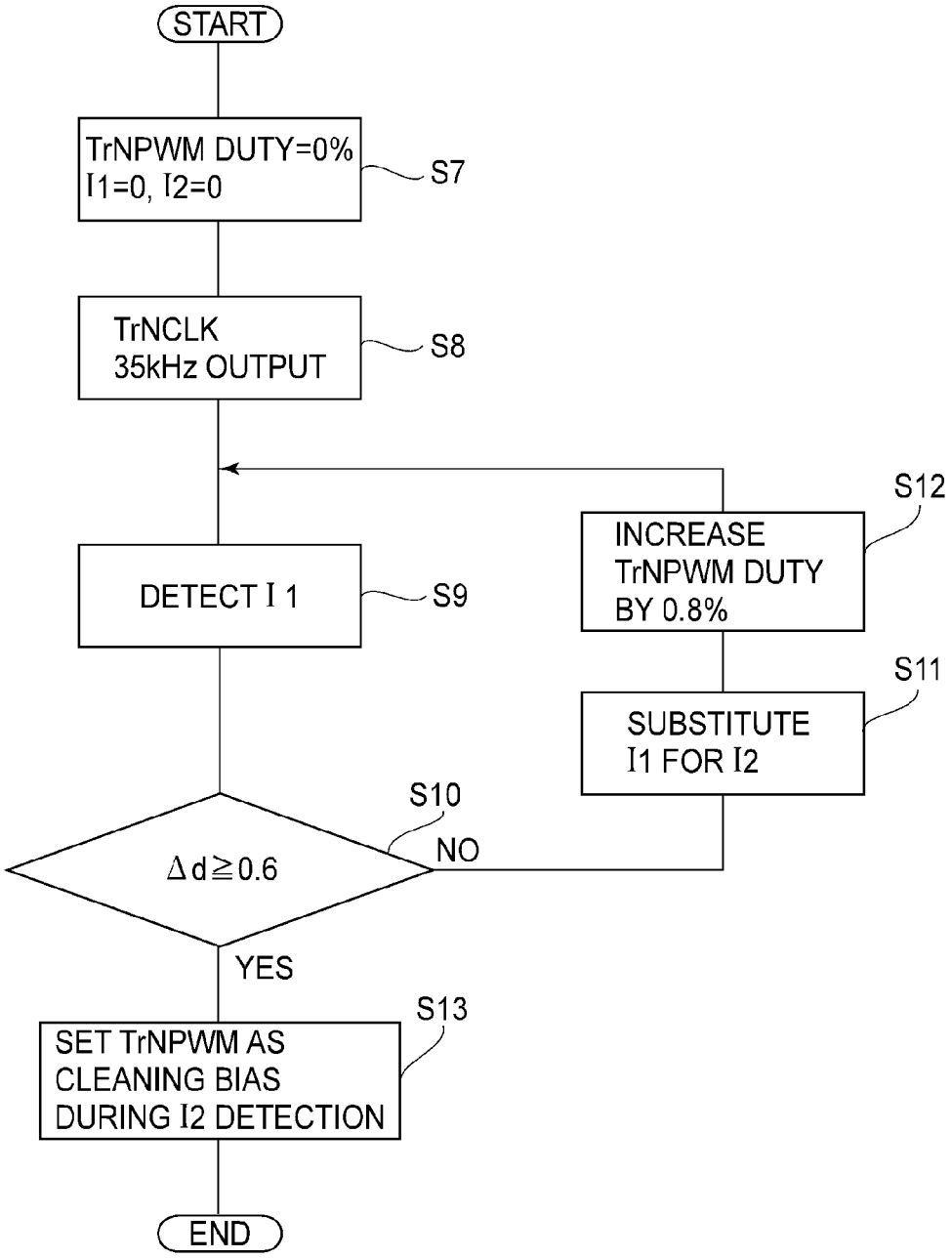
FIG. 5 is a flow chart showing high-voltage control for transfer in Embodiment 2 of the present invention.

FIG. 5 is a flow chart showing a setting procedure of the value of the transfer voltage to be applied to the transfer roller 3 during the transfer-roller cleaning.

First, the duty of the TrNPWM signal is set at 0%, and each of the values of detection currents I1 and I2 is set at an initial value (=0) (S7). As a result, the level of the transfer voltage is set at about zero.

Next, a clock signal of 35 kHz is inputted into the TrNCLK signal (S8). At this time, the duty of the TrNPWM signal is 0% and thus the transfer output is 0 V. Then, the current value I1 flowing at this time is monitored (S9). From the monitored current value, the slope Δd of the current with respect to the transfer voltage is calculated and is determined whether or not the slope Δd is 0.6 or more (S10). When the slope Δd is less than 0.6, the value of the current value I1 substituted for I2 (S11), and the duty of the TrNPWM signal is increased by 0.8% (2/255 (%)) (S12) and then the current value I1 is monitored again to determine the slope Δd (S10). This procedure is continued until the slope Δd is 0.6 μA or more. When the slope Δd is determined as being 0.6 μA or more, the duty of the TrNPWM signal at the time of detecting the current value I2 in the immediately preceding step is taken as the set value further TrNPWM signal during the transfer-roller cleaning (S13).

As described above, in this embodiment, the transfer device T includes the negative transfer-voltage circuit 4B capable of variably changing the output. The transfer device T performs the setting of the voltage value during the transfer-roller cleaning depending on the difference in slope of the current value with respect to the transfer voltage in a non-electric discharge area and an electric discharge area in which the current passes through the transfer-voltage circuit. Specifically, the CPU 49 sets the TrNPWM signal so that the slope Δd is 0.6.

As a result, the transfer-voltage value is set at a value that is lower than the surface potential of the photosensitive drum 1 by about −100 V, so that the toner can be moved from the transfer roller 3 onto the photosensitive drum 1 with reliability. Further, the transfer-voltage value is set at the value causing no electric discharge between the photosensitive drum 1 and the transfer roller 3, and therefore, the surface potential of the photosensitive drum 1 is not influenced by the transfer-voltage value.

Therefore, the toner moved to the photosensitive drum 1 is reliably carried to the residual-toner container 5 by the repulsive force with respect to the surface potential of the photosensitive drum 1 without being separated from the photosensitive-drum surface.

Thus, it is possible to prevent backside contamination of the sheet and toner scattering inside the image forming apparatus.

Embodiment 3

An image forming apparatus in this embodiment will be described.

Also in this embodiment, the image forming apparatus has the same constitution as that of the image forming apparatus 100 described in Embodiment 1 with reference to FIG. 1, and thus, a description thereof is being omitted as being redundant.

A constitution of the transfer-voltage source (transfer voltage generating means) 4 in this embodiment is shown in FIG. 3. In this embodiment, the transfer-voltage source 4 is constituted by a positive voltage circuit 4A, a negative voltage circuit 4B and a current-detecting circuit 4C as a current detecting means.

Figure 6:
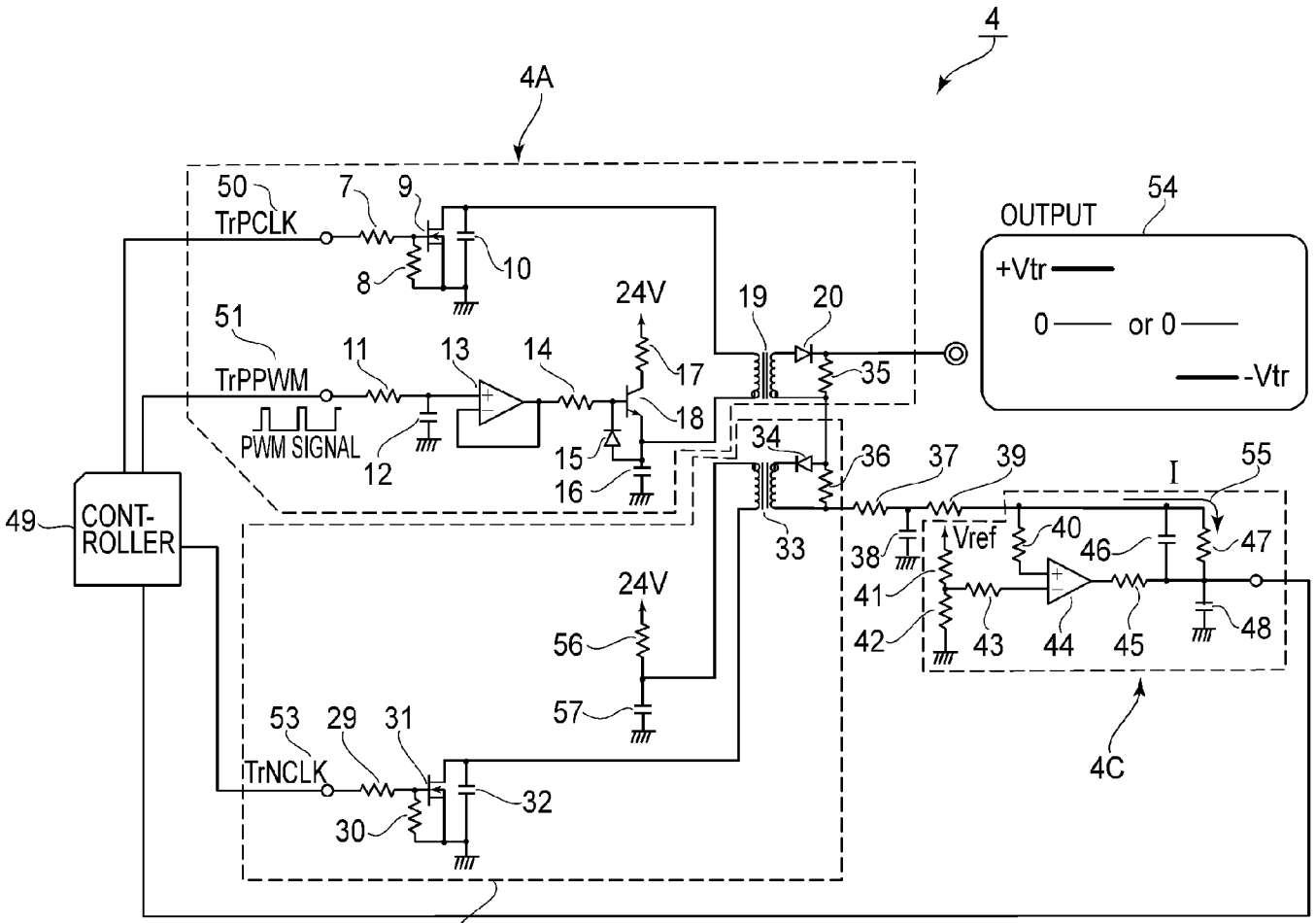
FIG. 6 is a circuit diagram for generating high-voltage output for transfer in Embodiment 3 and Embodiment 4 of the present invention.

Referring to FIG. 6, the transfer-voltage source 4 includes, as electric circuit constituent elements, high-voltage transformers 19 and 33; transistor 18; FETs 9 and 31; high voltage diodes 20 and 34; diode 15; operational amplifiers 13 and 44; capacitors 10, 12, 16, 32, 38, 46, 48 and 57; a controller (CPU) 49, and resistors 7, 8, 11, 14, 17, 29, 30, 35, 36, 37, 39, 40, 41, 42, 43, 45 47, and 56.

A high-voltage output for transfer from the transfer-voltage source 4 is a voltage 54 which includes DC components of the positive polarity and the negative polarity. The level of the DC voltage of the positive polarity can be changed variably, but the level of the DC voltage of the negative polarity is kept constant.

Here, the operation of the positive voltage circuit 4A is the same as that in Embodiment 1.

Next, with reference to FIG. 6, an operation of the negative transfer-voltage circuit 4B will be described.

The voltage of the negative polarity is a constant voltage and therefore the primary voltage of the high-voltage transformer 33 is constant at 24 V. Further, the signal for performing the driving of the high-voltage transformer 33 is TrNCLK 53, which is the clock signal. By performing the switching driving of the high-voltage transformer 33 by the clock signal TrNCLK 53 from the CPU 49, the primary voltage is amplified by the high-voltage transformer 33 and then is outputted. Here, the high-voltage output outputted to the secondary side of the transformer is an output of the negative polarity, depending on the winding direction and the turn ratio of coils of the high-voltage transformer 33.

Then, an operation of the current-detecting circuit 4C for detecting the current passing through the transfer-voltage circuit is the same as that described in Embodiment 1.

Next, a transfer-voltage-setting method during printing will be described.

In this embodiment, the voltage applied to the transfer roller 3 during the printing is of the positive polarity. Further, the toner image formed on the photosensitive-drum surface after the developing process assumes the negative electric charge. Therefore, the high voltage of the positive polarity is applied to the transfer roller 3 of the transfer means T, so that the toner image is transferred from the photosensitive-drum surface onto the sheet P. At this time, an output I of the current-detecting circuit 4C is monitored and adjustment of the duty of the PWM signal is performed that the current of 8.5 μA flows. That is, a detected voltage value is obtained by adding a voltage drop, during passage of the current of 8.5 μA through the detection resistor 47, to the reference voltage of 0.5 V. In this embodiment, the resistance of the resistor 47 is 100 kΩ, so that the detected voltage value is 1.35 V. The PWM duty when the voltage of 1.35 V is detected by the CPU is taken as a set value for the transfer voltage to be applied.

Next, the transfer-voltage-setting method during cleaning of the transfer roller 3 will be described.

During the cleaning, the voltage applied to the transfer roller 3 is of the negative polarity. Here, toner 6 assumes a negative electric charge, and therefore, the toner deposited on the transfer roller 3 can be moved to the photosensitive drum 1 by applying a voltage of the negative polarity to the transfer roller 3. The toner 6 moved on the photosensitive drum 1 is collected in the residual-toner container 5.

The value of the transfer voltage applied to the transfer roller 3 at that time is determined by monitoring the output I of the current-detecting circuit 4C and then by performing adjustment of the duty of the PWM signal so as to detect the current value of 1 μA in an area in which the electric discharge of the current does not occur between the photosensitive drum 1 and the transfer roller 3 as shown in the graph of FIG. 9. However, the voltage of the negative polarity is not variable, but is a constant output, and therefore, the voltage level is adjusted by superposing the voltage of the positive polarity having a variable voltage level.

At this time, the detected voltage is 0.4 V, which is obtained by subtracting the voltage drop, when the current of 1 μA passes through the detection resistor 47, from the reference voltage of 0.5 V. The PWM duty at the time of detecting the voltage of 0.4 V by the CPU 49 is taken as the set value for the transfer voltage. At this time, the surface potential of the photosensitive drum 1 is about −600 V, and the transfer voltage is set at a value larger than the photosensitive-drum-surface potential by 100 V in absolute value, i.e., set at about −700 V.

Figure 7:
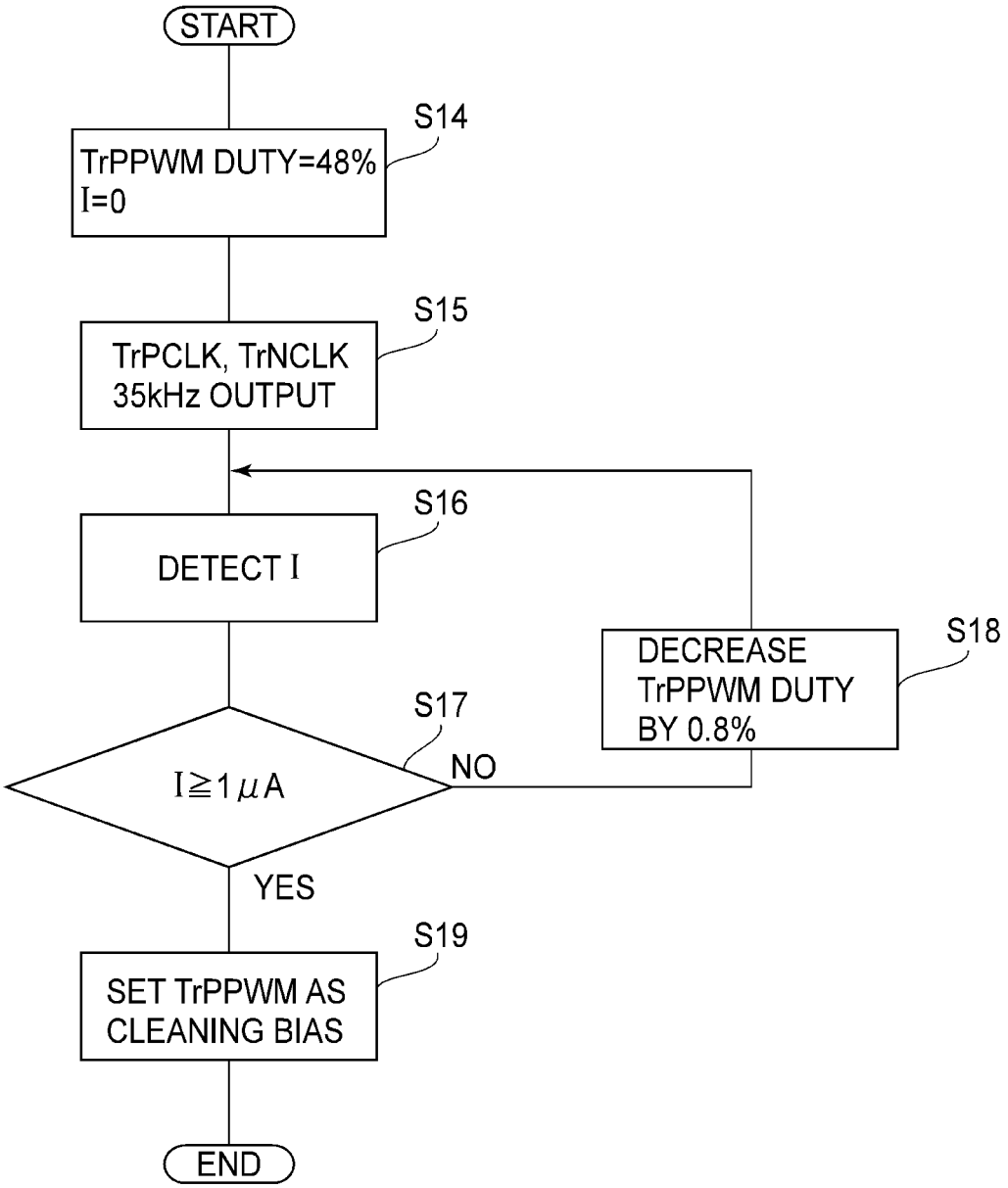
FIG. 7 is a flow chart showing high-voltage control for transfer in Embodiment 3 of the present invention.

FIG. 7 is a flow chart showing a setting procedure of the value of the transfer voltage to be applied to the transfer roller 3 during the transfer-roller cleaning.

First, the duty of the TrPPWM signal is set at 48%, and the value of a detection current I is set at an initial value (=0) (S14). As a result, the level of the transfer voltage is set at about zero.

Next, a clock signal of 35 kHz is inputted into each of the TrPCLK signal and the TrNCLK signal (S15). At this time, a positive output corresponding to the duty of the TrPPWM signal of 48% is +2500 V and on the other hand, a negative output is constant at −2500 V. That is, the transfer output is the sum of the positive and negative outputs, i.e., 0 V. Then, the current value I flowing at this time is monitored (S16). It is determined whether the monitored current value (absolute value) I is 1 μA or more (S17). When the monitored current value I is less than 1 μA, the duty of the TrPPWM signal is decreased by 0.8% (2/255 (%)) (S18) and then the current I is monitored again (S17). This procedure is continued until the current value (absolute value) I is 1 μA or more. When the current value I is determined as being 1 μA or more, the duty of the TrPPWM signal is taken as the set value further TrPPWM signal during the transfer-roller cleaning (S19).

As described above, in this embodiment, in the transfer means T including the negative transfer-voltage circuit 4B from which the output of the voltage is not variable, but is constant, the voltage of the positive polarity is superposedly applied in order to adjust the level of the voltage of the negative polarity. The CPU 49 performs the setting of the voltage value during the transfer-roller cleaning by the transfer means T so that the TrPPWM signal is set so as to provide the current value of 1 μA, which is a value in the non-electric discharge area of the current passing through the transfer-voltage circuit.

As a result, the transfer-voltage value is set at a value that is higher than the surface potential of the photosensitive drum 1 by about −100 V, so that the toner can be moved from the transfer roller 3 onto the photosensitive drum 1 with reliability. Further, the transfer-voltage value is set at the value causing no electric discharge between the photosensitive drum 1 and the transfer roller 3, and therefore, the surface potential of the photosensitive drum 1 is not influenced by the transfer-voltage value.

Therefore, the toner moved to the photosensitive drum 1 is reliably carried to the residual-toner container 5 by the repulsive force with respect to the surface potential of the photosensitive drum 1 without being separated from the photosensitive-drum surface.

Thus, it is possible to prevent the backside contamination of the sheet and the toner scattering inside the image forming apparatus.

Embodiment 4

An image forming apparatus in this embodiment will be described.

Also in this embodiment, the image forming apparatus has the same constitution as that of the image forming apparatus 100 described in Embodiment 1 with reference to FIG. 1, and thus, a description thereof is being omitted as being redundant.

Further, in this embodiment, the transfer-voltage source has the same constitution as that of the transfer-voltage source 4 described in Embodiment 3 with reference to FIG. 6, and thus, a description thereof is being omitted as being redundant.

In this embodiment, the operations of the positive transfer-voltage source 4A and the negative transfer-voltage circuit 4B are the same as that in Embodiment 1 and that in Embodiment 3, respectively. The operation of the current-detecting circuit 4C in this embodiment is the same as that in Embodiment 1.

Next, a transfer-voltage-setting method during printing will be described.

In this embodiment, the voltage applied to the transfer roller 3 during the printing is of a positive polarity. Further, the toner image formed on the photosensitive-drum surface after the developing process assumes a negative electric charge. Therefore, the high voltage of the positive polarity is applied to the transfer roller 3 of the transfer means T, so that the toner image is transferred from the photosensitive-drum surface onto the sheet P. At this time, an output I of the current-detecting circuit 4C is monitored and adjustment of the duty of the PWM signal is performed so that the current of 8.5 μA flows. That is, a detected voltage value is obtained by adding a voltage drop, during passage of the current of 8.5 μA through the detection resistor 47, to the reference voltage of 0.5 V. In this embodiment, the resistance of the resistor 47 is 100 kΩ, so that the detected voltage value is 1.35 V. The PWM duty when the voltage of 1.35 V is detected by the CPU is taken as a set value for the transfer voltage to be applied.

Next, the transfer-voltage-setting method during cleaning of the transfer roller 3 will be described.

During the cleaning, the voltage applied to the transfer roller 3 is of a negative polarity. Here, the toner 6 assumes a negative electric charge, and therefore, the toner deposited on the transfer roller 3 can be moved to the photosensitive drum 1 by applying the voltage of the negative polarity to the transfer roller 3. The toner 6 moved on the photosensitive drum 1 is collected in the residual-toner container 5.

A value of the transfer voltage applied to the transfer roller 3 at that time is determined by monitoring the output I of the current-detecting circuit 4C and then by performing adjustment of the duty of the PWM signal so as to detect a point at which a slope Δd of the current value with respect to the transfer voltage is changed from Δd1 in an area in which the electric discharge does not occur between the photosensitive drum 1 and the transfer roller 3 to Δd2 in an area in which the electric discharge occurs as shown in the graph of FIG. 9. However, the voltage of the negative polarity is not variable, but is a constant output, and therefore, the voltage level is adjusted by superposedly applying the voltage of the positive polarity having the variable level. That is, the transfer-voltage value is gradually increased and the electric discharge of the current is started, so that the point at which the slope of the current value with respect to the transfer voltage is changed from Δd1=0.06 to Δd2=0.6 is detected. Therefore, the PWM duty immediately before the detection by the CPU (controller) 49 that the slope reaches Δd2=0.6 is taken as the set value for the transfer voltage. At this time, the surface potential of the photosensitive drum 1 is about −600 V, and the transfer voltage is set at a value larger than the photosensitive-drum-surface potential by 100 V in absolute value, i.e., set at about −700 V.

Figure 8:
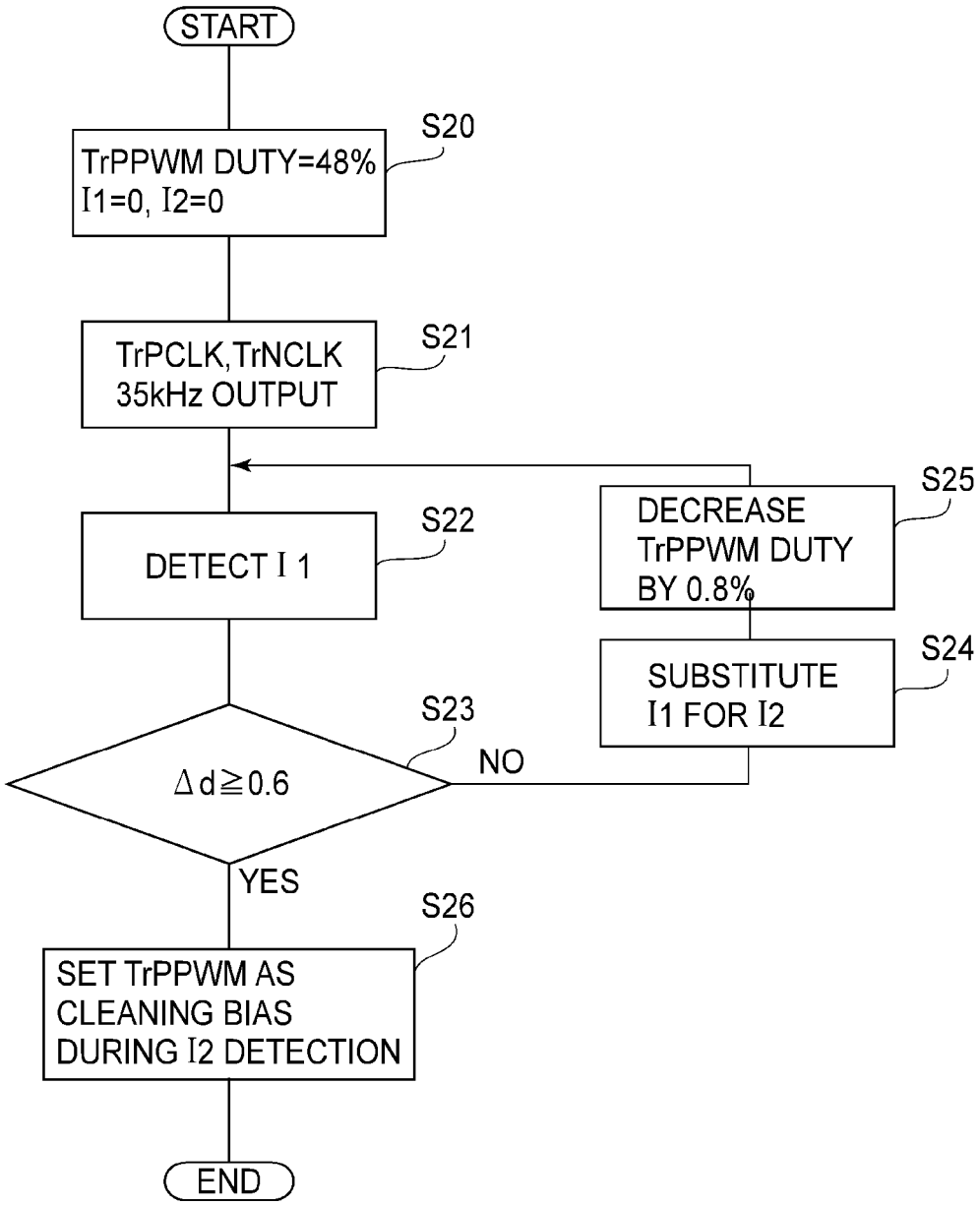
FIG. 8 is a flow chart showing high-voltage control for transfer in Embodiment 4 of the present invention.

FIG. 8 is a flow chart showing a setting procedure of the value of the transfer voltage to be applied to the transfer roller 3 during the transfer-roller cleaning.

First, the duty of the TrNPWM signal is set at 48%, and each of the values of detection currents I1 and I2 is set at an initial value (=0) (S20). As a result, the level of the transfer voltage is set at about zero.

Next, a clock signal of 35 kHz is inputted into each of the TrPCLK and TrNCLK signals (S21). At this time, a positive output to the duty of the TrPPWM signal of 48% is +2500 V, and on the other hand, a negative output is constant at −2500 V. That is, a transfer output is the sum of the positive and negative outputs, i.e., 0 V. Then, the current value I1 flowing at this time is monitored (S22). From the monitored current value, the slope Δd of the current with respect to the transfer voltage is calculated and it is determined whether or not the slope Δd is 0.6 or more (S23). When the slope Δd is less than 0.6, the value of the current value I1 substituted for I2 (S24), and the duty of the TrPPWM signal is decreased by 0.8% (2/255 (%)) (S25) and then the current value I1 is monitored again to determine the slope Δd (S23). This procedure is continued until the slope Δd is 0.6 μA or more. When the slope Δd is determined as being 0.6 μA or more, the duty of the TrPPWM signal at the time of detecting the current value I2 in the immediately preceding step is taken as the set value further TrPPWM signal during the transfer-roller cleaning (S26).

As described above, in this embodiment, in the transfer means T including the negative transfer-voltage circuit 4B from which the output of the voltage is not variable but is constant, the voltage of the positive polarity is superposed in order to adjust the level of the voltage of the negative polarity. The setting of the voltage value during the transfer-roller cleaning is performed depending on the difference in slope of the current value with respect to the transfer voltage in a non-electric discharge area and an electric discharge area in which the current passes through the transfer-voltage circuit. Specifically, the TrPPWM signal is set so that the slope Δd is 0.6.

As a result, the transfer-voltage value is set at a value that is lower than the surface potential of the photosensitive drum 1 by about −100 V, so that the toner can be moved from the transfer roller 3 onto the photosensitive drum 1 with reliability. Further, the transfer-voltage value is set at the value causing no electric discharge between the photosensitive drum 1 and the transfer roller 3, and therefore, the surface potential of the photosensitive drum 1 is not influenced by the transfer-voltage value.

Therefore, the toner moved to the photosensitive drum 1 is reliably carried to the residual-toner container 5 by the repulsive force with respect to the surface potential of the photosensitive drum 1 without being separated from the photosensitive-drum surface.

Thus, it is possible to prevent backside contamination of the sheet and toner scattering inside the image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 288516/2009 filed Dec. 18, 2009, which is hereby incorporated by reference.

What is claimed is:

1. An image forming apparatus comprising:

an image bearing member;

a charging device configured to electrically charge said image bearing member;

an electrostatic latent image forming device configured to form an electrostatic latent image on said image bearing member;

a developing device configured to develop the electrostatic latent image into a toner image;

a transfer device configured to transfer the toner image from said image bearing member onto a recording material, said transfer device including a transfer member to which a transfer voltage is to be applied, a transfer voltage source configured to variably set the transfer voltage, and a current detecting circuit configured to detect a current passing between said image bearing member and the transfer member by the transfer voltage applied from the transfer voltage source, wherein the transfer voltage source is configured to apply to the transfer member a voltage of a negative polarity and a voltage of a positive polarity; and a controller configured to control the transfer voltage source, wherein said controller sets a value of the transfer voltage, to be applied from the transfer voltage source during a non-passing period of the recording material, so that a predetermined current is detected by said current detecting circuit, wherein the predetermined current is preset as a current not causing electric discharge between said image bearing member and the transfer member but causing the toner image to move from the transfer member to said image bearing member, and wherein when the current detecting circuit detects the value of the current passing between said image bearing member and the transfer member, said controller applies a superposition of the voltage of the negative polarity and the voltage of the positive polarity and variably changes values of the voltages.

2. An apparatus according to claim 1, wherein the transfer voltage source is configured to output the voltage of the negative polarity as a constant voltage and output the voltage of the positive polarity as a variable voltage.

* * * * *